United States Patent [19]

Kikuchi

[11] 4,177,839

[45] Dec. 11, 1979

[54] WEBBING FOR SEAT BELT

[75] Inventor: Kouichi Kikuchi, Haibara, Japan

[73] Assignees: NSK-Warner K.K.; Kikuchi Kogyo K. K., both of Tokyo, Japan

[21] Appl. No.: 917,587

[22] Filed: Jun. 21, 1978

Related U.S. Application Data

[60] Division of Ser. No. 781,433, Mar. 25, 1977, abandoned, which is a continuation-in-part of Ser. No. 652,771, Jan. 27, 1976, abandoned.

[51] Int. Cl.[2] ..... D03D 15/00

[52] U.S. Cl. ..... 139/419; 139/426 R

[58] Field of Search ..... 139/383 R, 384 R, 419, 139/416, 420 R, 426 R, 408, 409, 410, 411, 412, 413, 414, 415

[56] References Cited

U.S. PATENT DOCUMENTS

| | | | |
|---|---|---|---|
| 2,212,378 | 8/1940 | Randall | 139/419 |
| 2,471,166 | 5/1949 | Neff | 139/384 R |
| 2,609,013 | 9/1952 | Amyot | 139/384 R |
| 2,794,450 | 6/1957 | Gatzke | 139/411 |
| 3,249,128 | 5/1966 | Lord | 139/419 |
| 3,296,062 | 1/1967 | Truslow | 139/426 R |
| 3,756,288 | 9/1973 | Seo et al. | 139/383 R |
| 3,823,748 | 7/1974 | Allman et al. | 139/383 R |
| 3,872,895 | 3/1975 | Takada | 139/383 R |
| 3,926,227 | 12/1975 | Takada | 139/383 R |
| 4,004,616 | 1/1977 | Andronov | 139/383 R |

*Primary Examiner*—Henry Jaudon

*Attorney, Agent, or Firm*—Shapiro and Shapiro

[57] ABSTRACT

Webbing is formed by weaving wefts and warps of high extensibility and has warp threads of low or medium extensibility suitably spaced apart in the widthwise direction of the webbing and woven into the webbing to form energy absorbing portions.

1 Claim, 15 Drawing Figures

WEBBING FOR SEAT BELT

This application is a division of application Ser. No. 781,433 filed Mar. 25, 1977, which is a continuation-in-part of application Ser. No. 652,771 filed Jan. 27, 1976, both now abandoned.

BACKGROUND OF THE INVENTION

1. Field of the Invention

This invention relates to the webbing for vehicle seat belts, and more particularly to energy absorbing webbing for seat belts which, as compared with the prior art webbing, has a much greater ability to absorb energies of abrupt shocks imparted to the vehicle occupant.

2. Description of the Prior Art

The prior art webbing of this type includes that which is designed to indicate that the webbing has been too much elongated to be used upon an impact exerted thereon, or the threepoint belt in which the waist belt and the shoulder belt have different factors of permanent deformation so as to protect the human body against shocks imparted thereto. According to the prior art, as shown in FIG. 1 of the accompanying drawings, the elongation of the webbing progresses under a low load gradually increasing as indicated by the dotted line until the webbing is broken under a small rate of elongation, and such webbing has been low in energy absorbing ability for abrupt shocks imparted thereto.

SUMMARY OF THE INVENTION

It is therefore a first object of the present invention to provide webbing for seat belt having a higher energy absorbing ability than the webbing of the prior art.

It is a second object of the present invention to provide webbing constructed such that the load at the initial stage of an impact (hereinafter referred to as rising load) is greater than the conventional webbing and the rising load is continuedly maintained while the elongation of the webbing is increased, thereby ensuring a great energy absorbing ability.

It is a third object of the present invention to provide webbing which has a greater elongation percentage than the prior art webbing and also has a sufficient strength to prevent break of the webbing for a greater load than expected, whereby break of the webbing may be prevented when a greater energy than expected is imparted thereto, so that the vehicle occupant may be protected more completely against shocks.

Other objects and features of the present invention will become apparent from the following detailed description of some preferred embodiments of the invention taken in conjunction with the accompanying drawings.

DESCRIPTION OF THE PREFERRED EMBODIMENTS

Figure 2:
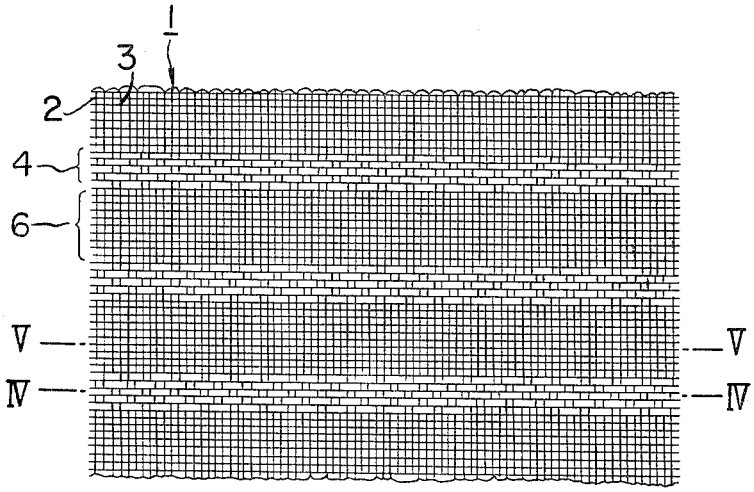
FIG. 2 is a plan view showing a portion of the weave structure of the webbing according to a first embodiment of the present invention.

Referring to FIG. 2, webbing 1 is woven by using high extensibility threads of 60% or higher breaking extensibility as wefts 3 and warps 2, and as shown in FIG. 2, a plurality of tubular portions 4 extending lengthwise of the webbing and spaced apart from one another widthwise thereof.

Figure 3:
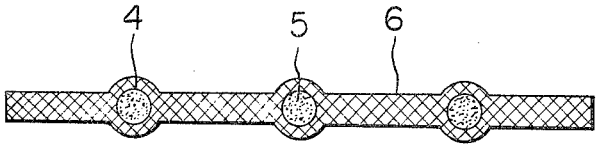
FIG. 3 is a schematic, enlarged, transverse cross-sectional view of the webbing according to the first embodiment.

As is particularly shown in FIG. 3 which is a transverse cross-sectional view of the webbing, each tubular portion 4 includes therein low extensibility warps 5 which are lower in breaking extensibility than the wefts 3 and warps 2. The low extensibility warps 5 extends straight within the tubular portion 4 and without being entangled or interlaced with any other thread, and is in such a condition that it can be withdrawn out of the tubular portion 4 when the webbing 1 is cut into a short length.

Figure 4:
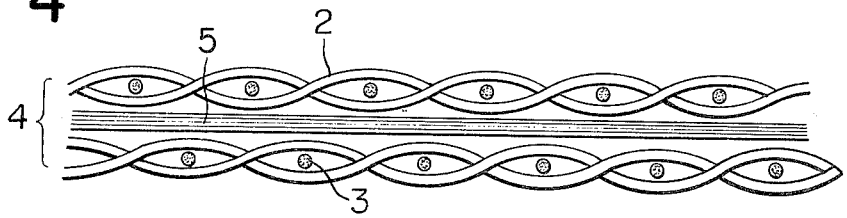
FIG. 4 is a view of the webbing taken along line IV—IV in FIG. 2.
Figure 5:
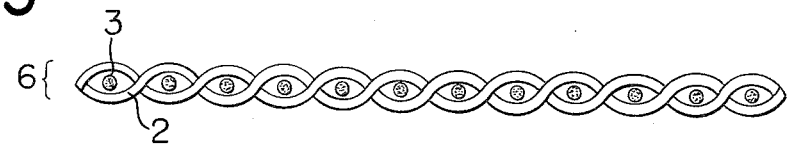
FIG. 5 is a view of the webbing taken along line VI—VI in FIG. 2.

Also, as is contrastingly shown in FIGS. 4 and 5, the textile is divided into two parts and therefore, the number of weft threads 3 in the tubular portions 4 is half that in the other portion 6 of the textile (FIG. 5). Accordingly, the bends of the warps 2 in the tubular portions 4 are half the bends of the warps 2 in said other portion 6 and thus, the warps in the tubular portions is less extensible when subjected to a tensile load.

Figure 1:
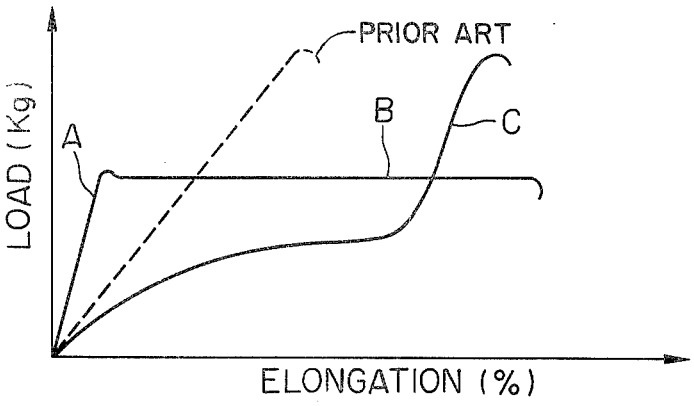
FIG. 1 is a graph illustrating the relation between the load and the elongation percentage of the webbing, wherein solid lines A–B and C refer to the webbing of the present invention.

In the webbing of the present invention constructed in the manner described above, it is to be understood that at the initial stage of the tensile load imparted thereto, the low extensibility warps 5 in the tubular portions 4 resist the load to increase the rising load as indicated at A in FIG. 1. Then, the low extensibility warps 5 become unable to withstand the load and break, whereafter the broken low extensibility warps 5 slip within the tubular portions 4 and do not interfere with the elongation of the tubular portions 4. The tubular portions 4 and the other portion 6 continue to elongate while supporting the load, but since the tubular portions 4 are less extensible than the other portion 6, the tubular portions elongate while maintaining the rising load and thus, coupled with the elongation of the other portion 6, the webbing 1 elongates as indicated at B in FIG. 1. The tubular portions 4 are spaced apart from one another with the portion 6 intervening therebetween and this also contributes to the readiness with which the webbing elongates. Such elongation of the webbing is increased by the use of the high extensibility threads, as compared with the prior art. As a result of these, the present webbing is much greater in energy absorbing ability than the conventional one and highly effective to insure the safety of the human body.

Figure 6:
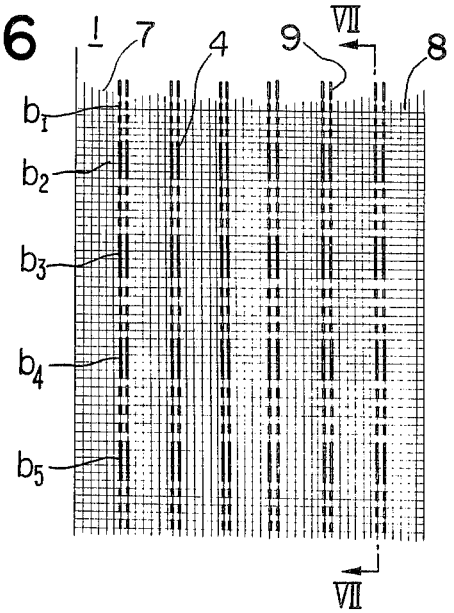
FIG. 6 is a plan view showing a portion of the weave structure of the webbing according to a second embodiment of the present invention.
Figure 7:
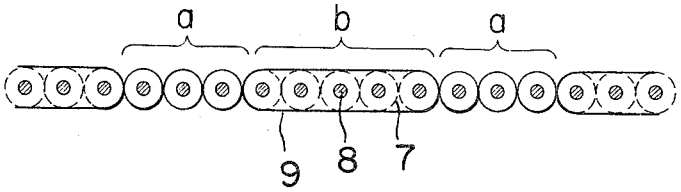
FIG. 7 is a schematic, enlarged cross-sectional view taken along line VII—VII in FIG. 6.
Figure 8:
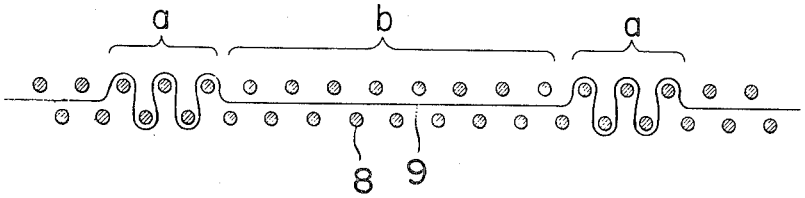
FIG. 8 is a schematic, enlarged, cross-sectional view showing a modified form of the weave structure in the portion corresponding to that shown in FIG. 7.

Referring to FIGS. 6 and 7 which show a second embodiment of the present invention, there is illustrated the theoretical structure of the textile. The webbing 1 is formed by warps 7 and wefts 8 of 60% or higher breaking extensibility and a plurality of warp threads 9 which are low breaking extensibility threads having a breaking extensibility less than 60%. As shown in FIG. 7, this webbing is constructed by alternately and continuously weaving portions a comprising a plurality of weft threads 8 individually locked by or interlaced with low extensibility threads 9 (hereinafter referred to as locked portions) and portions b comprising a plurality of weft threads 8 lumped together but not individually locked (hereinafter referred to as unlocked portions). Alternatively, as shown in a modified form of FIG. 8, the weave may be done in such a manner that the unlocked portions b are not exposed on the surface of the webbing 1.

Although the locked portions a have been described as comprising weft threads 8 individually locked by low extensibility warp 9, this is merely an illustration adopted to assist in understanding the technical concept of the invention and the shown number of weft threads 8 is not restrictive but, it is simply meant to accentuate that the low extensibility warp threads 9 are woven more densely or more frequently interlaced with the wefts in the locked portions a than in the unlocked portions b.

In the webbing of the second embodiment constructed as described, it is to be understood that at the initial stage of the tensile load imparted threrto, the low extensibility warp threads 9 resist the load to increase the rising load as indicated at A in FIG. 1. Subsequently, the unlocked portions b using the low extensibility warp threads 9 become unable to withstand the load and break in succession. More particularly, in FIG. 6, the unlocked portion $b_3$ is first broken, for example to permit elongation of the high extensibility threads 7 in that portion, whereafter the unlocked portions $b_2$ and $b_4$ adjacent to the initially broken unlocked portion $b_3$ are broken to permit elongation of the high extensibility threads 7 in these portions. Such phenomenon recurs in successive portions of the webbing so that the high extensibility threads 7 can uninterruptedly elongate while maintaining the rising load and thus, the webbing elongates as indicated at B in FIG. 1. Such elongation of the webbing is increased by the use of the high extensibility threads, as compared with the prior art. As a result, the present webbing is much greater in energy absorbing ability than the conventional webbing and highly effective to insure the safety of the human body.

Figure 9:
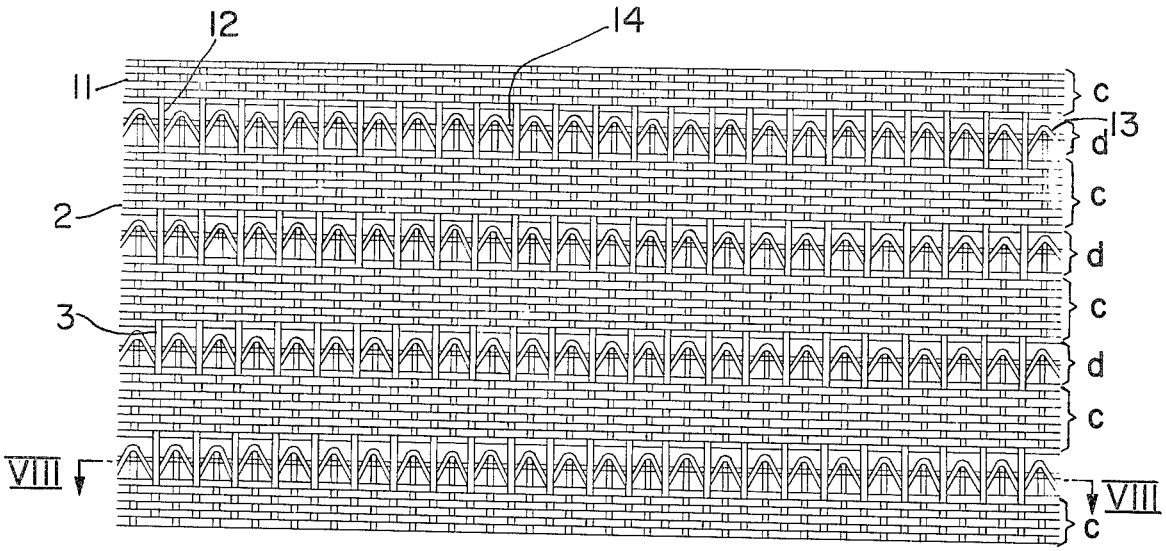
FIG. 9 is a plan view showing a portion of the weave structure according to a third embodiment.
Figure 10:
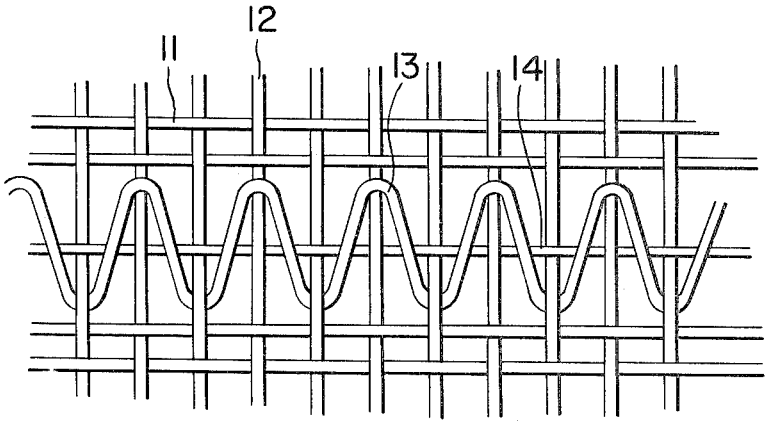
FIG. 10 is a fragmentary, enlarged plan view corresponding to FIG. 9.

Referring to FIGS. 9 and 10 which show a third embodiment of the present invention, the webbing consists of high extensibility threads of 60% or higher breaking extensibility employed as warps 11 and wefts 12, and further includes portions d spaced apart from one another and using warps 13 compriring high strength threads of low or medium extensibility lower than the extensibility of the warps 11. The portions c comprising wefts 12 and warps 11 of high extensibility threads and portions d comprising warps 13 of low or medium extensibility and high strength threads and wefts 12 of high extensibility threads are disposed alternately in the widthwise direction of the webbing, as shown in FIG. 9, and the portions d may take various forms. In the third embodiment shown in FIGS. 9 and 10, the warps 13 are undulated in the widthwise direction of the webbing and thus, a greater length of thread than the length of the high extensibility warps 11 is required to weave a unit length of the webbing. Further, thin warps 14 of low extensibility are also woven into each portion d so as to prevent the warps 13 from coming loose under no-load conditions, but when the warps 13 are pulled with a strong force, the low extensibility warps 14 may be broken to permit the warps 13 to come loose and elongate.

Figure 11:
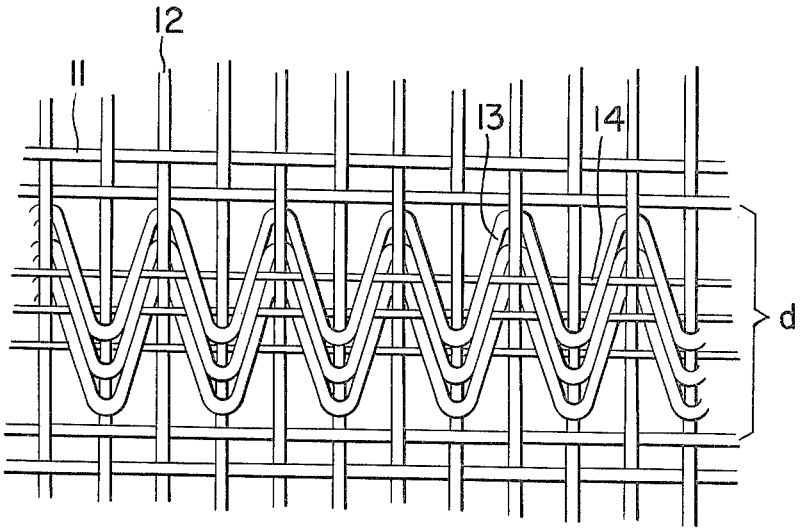
FIG. 11 is an enlarged plan view showing a modification of the FIG. 10 form.

FIG. 11 shows another form in which three threads of low or medium extensibility and high strength are woven into each portion d in an undulated manner similar to that in the embodiment of FIG. 10.

Figure 12:
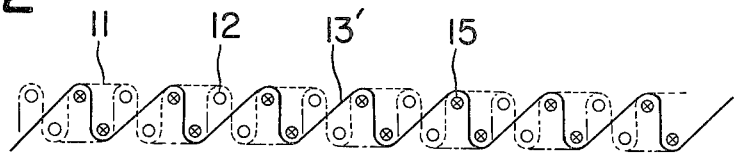
FIG. 12 is a view taken along line VIII—VIII in FIG. 9 and schematically illustrating the manner of weaving including the woven conditions shown in FIGS. 13 to 15.
Figure 14:
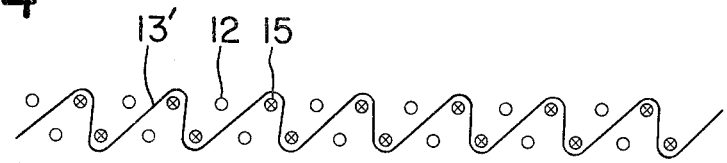

FIG. 12 shows still another modified form of the portion d and corresponds to the condition on line VIII—VIII in FIG. 9. In this instance, the warps 13' using the low or medium extensibility and high strength thread is undulated in the direction of thickness of the webbing as seen in FIG. 14, and wefts 15 may be water-soluble vinylon which is removable by a treatment after weaving, or thin and weak nylon or similar material which may be readily broken upon a load exerted thereon. Thus, the warps 13', if pulled, may come loose and elongate.

Figure 13:
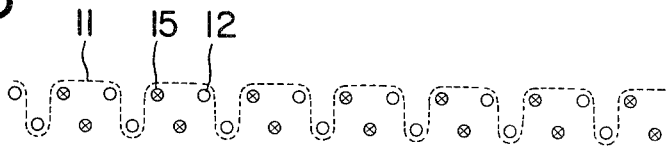
FIGS. 13 to 15 individually illustrate the manners in which the three types of warp shown in FIG. 12 are woven respectively.
Figure 15:
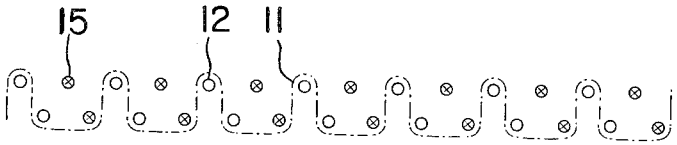

FIGS. 13 and 15 illustrate the relationship of the warps 11 and wefts 12 of high extensibility threads with the abovedescribed wefts 15, and FIG. 12 shows the state of the textile resulting from the synthesization of FIGS. 13 to 15. Although not shown, as still further modifications of the warp using low or medium extensibility and high strength thread, there may be a knit string form in which the thread can come loose and elongate when pulled on, or a composite thread form in which weak or well extensible thread is employed as a core and low or medium extensibility and high strength thread is wound on the core, and in these cases, such warps cooperate with the wefts 12 to form the portions d. In the foregoing forms, the extensible warps 13 or 13' have been described as being formed by thread of lower extensibility than the warps 11 whereas identical threads, if they are woven to be extensible as described above, may be employed for both the warps 13 or 13' and the warps 11. Also, the portions d are disposed alternately with the portions c and spaced apart from one another, whereas this arrangement is adopted merely from an aesthetic point of view and the portions d may be lumped together in the middle or provided at the opposite side edges without any inconvenience in practical use.

In the webbing of the third embodiment constructed as described above, the portions c using high extensibility threads as the wefts and warps are first elongated when subjected to a tensile load, and the rate of such elongation is greater than in the prior art because the high extensibility threads are used. At the same time, the warps 13 or 13' shown in FIGS 10 to 14 or the core of the composite thread are elongated. Elongation of the webbing exceeding a certain extent will cause the warps 13 or 13' in the portions d to come loose and elongate so as to undergo a tensile load. Thus, the load is shared by the portions c and d and this means that a great tensile load can be withstood to increase the load as indicated at C in FIG. 1, whereby the webbing may be prevented from breaking for a load greater than expected. As a result, the present webbing is much greater in energy absorbing ability than the conventional webbing and may be prevented from breaking, thus being highly effective to insure the safety of the human body.

What I claim is:

1. An energy-absorbing webbing for seat belts comprising wefts of high extensibility, first warps of high extensibility, second warps which are thin as compared with the first warps and have low extensibility, the second warps being interwoven in the webbing in widthwise spaced relationship, and third warps selected from threads of low and medium extensibility and interwoven in the webbing, the third warps being undulated in the widthwise direction of the webbing to form with the second warps a Leno weave construction.

* * * * *